US007104668B1

(12) United States Patent
Lee

(10) Patent No.: US 7,104,668 B1
(45) Date of Patent: Sep. 12, 2006

(54) STRUCTURE OF A SHINING PERSONAL ADORNMENT

(76) Inventor: Ching-Hui Lee, No. 13, Kangtzuwei, Madou Township, Tainan County (TW)

( * ) Notice: Subject to any disclaimer, the term of this patent is extended or adjusted under 35 U.S.C. 154(b) by 0 days.

(21) Appl. No.: 11/168,509

(22) Filed: Jun. 29, 2005

(51) Int. Cl.
*F21V 21/08* (2006.01)
*F21V 21/096* (2006.01)

(52) U.S. Cl. ..... 362/104; 362/103; 362/570

(58) Field of Classification Search ..... 362/103, 362/104, 208, 219, 234, 240, 249, 251, 394, 362/398, 555, 556, 570, 571; 63/3, 3.1
See application file for complete search history.

(56) References Cited

U.S. PATENT DOCUMENTS 3,641,333 A * 2/1972 Gendron ..... 362/108
3,911,264 A * 10/1975 Chao ..... 362/231
4,262,324 A * 4/1981 Murphy ..... 362/104
2002/0122316 A1* 9/2002 Hsieh ..... 362/570

* cited by examiner

*Primary Examiner*—Y. My Quach-Lee
(74) *Attorney, Agent, or Firm*—Rosenberg, Klein & Lee

(57) ABSTRACT

A shining personal adornment includes a hollow body, a shining unit held in the hollow body, a power supplying unit, a first connecting part joined to one end of the hollow body, a second connecting part joined to other end of the hollow body for separable connection with one end of the power supplying unit; the first connecting part has a threaded portion, and holds a conducting element therein, which is connected to the shining unit; the power supplying unit contains batteries therein, and has a threaded portion; the threaded portion of the first connecting part is threadedly engaged with the threaded portion of the power supplying unit; the conducting element will not be connected to the batteries, and the shining unit will not be powered if the threaded portions are loosely connected; the conducting element will be electrically connected to the batteries when both the threaded portions are tightly connected.

7 Claims, 5 Drawing Sheets

STRUCTURE OF A SHINING PERSONAL ADORNMENT

BACKGROUND OF THE INVENTION

1. Field of the Invention

The present invention relates to a shining personal adornment, more particularly one, which includes a hollow body, a shining unit held in the hollow body, a power supplying unit having a threaded portion, and a connecting part joined to one end of the hollow body; the first connecting part has a threaded portion, and contains a conducting element for electrical connection with the power supplying unit such that the shining unit will not be powered if both the threaded portions are loosely connected, and such that the shining unit will be powered when the threaded portions are tightly connected.

2. Brief Description of the Prior Art

Referring to FIG. 1, glowing sticks and electronic lighting tubes are often seen in concerts, parties, festivals etc, which are held in hands, and waved for helping create atmosphere in the scenes. However, the conventional glowing sticks and electronic lighting tubes can only be held in hands while the users are dancing or posture.

Furthermore, most of the conventional glowing sticks contain catalytic agent, and a kind of luminous chemical therein such that glow will be produced when the luminous chemical is mixed with the catalytic agent. Because the above-mentioned glowing sticks can only be used once, the chemical therein will cause pollution to the environment after discarded.

SUMMARY OF THE INVENTION

It is a main object of the invention to provide an improvement on a shining personal adornment to overcome the above problems. The shining personal adornment of the invention includes a hollow body, a shining unit held in the hollow body, a power supplying unit, a first connecting part joined to one end of the hollow body, a second connecting part joined to other end of the hollow body for separable connection with the power supplying unit. The first connecting part has a threaded portion, and holds a conducting element therein, which is connected to the shining unit. The power supplying unit contains batteries therein, and has a threaded portion. The threaded portion of the first connecting part is threadedly engaged with the threaded portion of the power supplying unit. The conducting element will not be connected to the batteries, and the shining unit will not be powered if the threaded portions are loosely connected. And, the conducting element will be electrically connected to the batteries when both of the threaded portions are tightly connected to each other.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
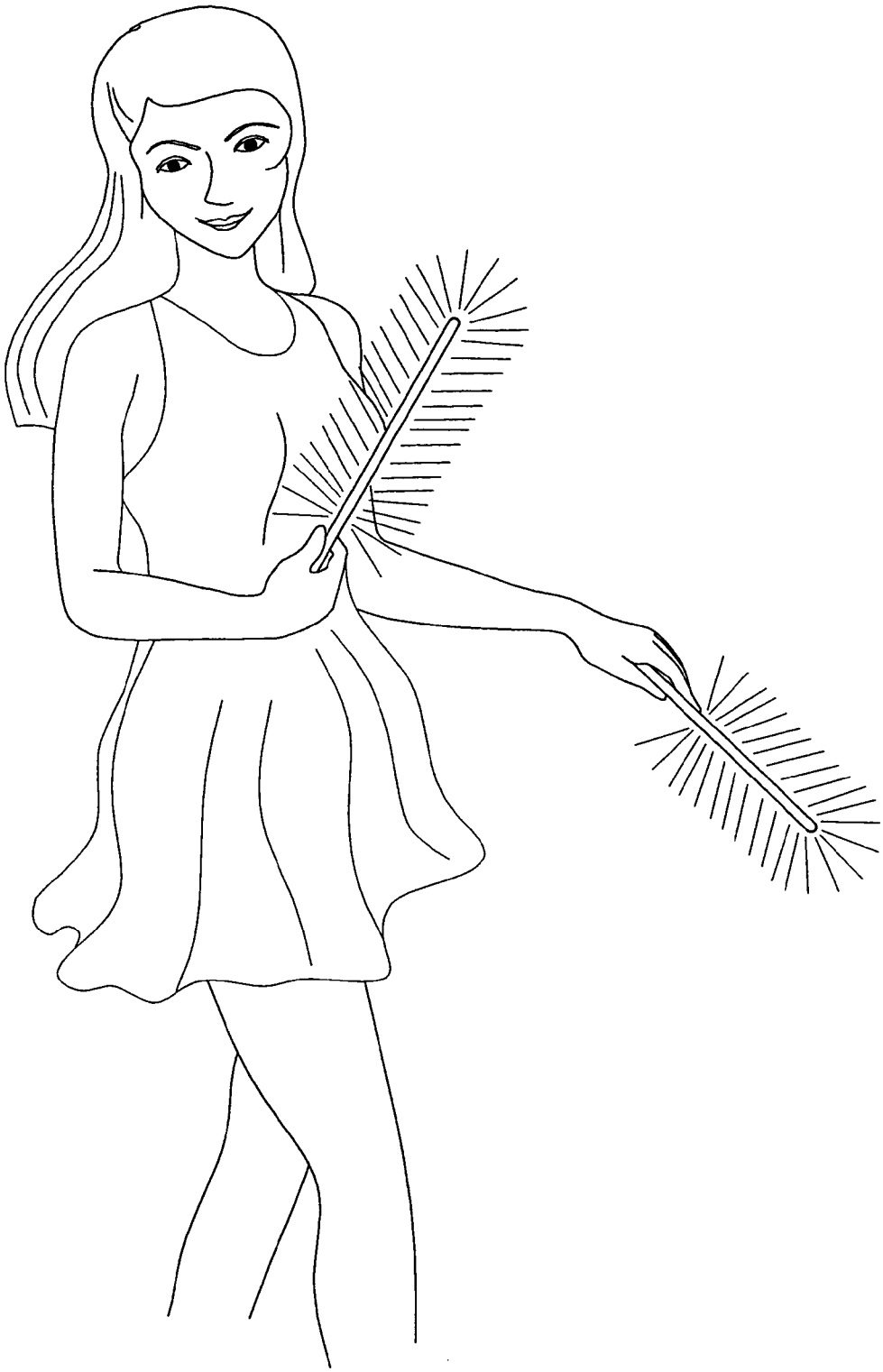
FIG. 1 (PRIOR ART)
FIG. 1 is a view showing a way to use conventional glowing sticks.
Figure 2:
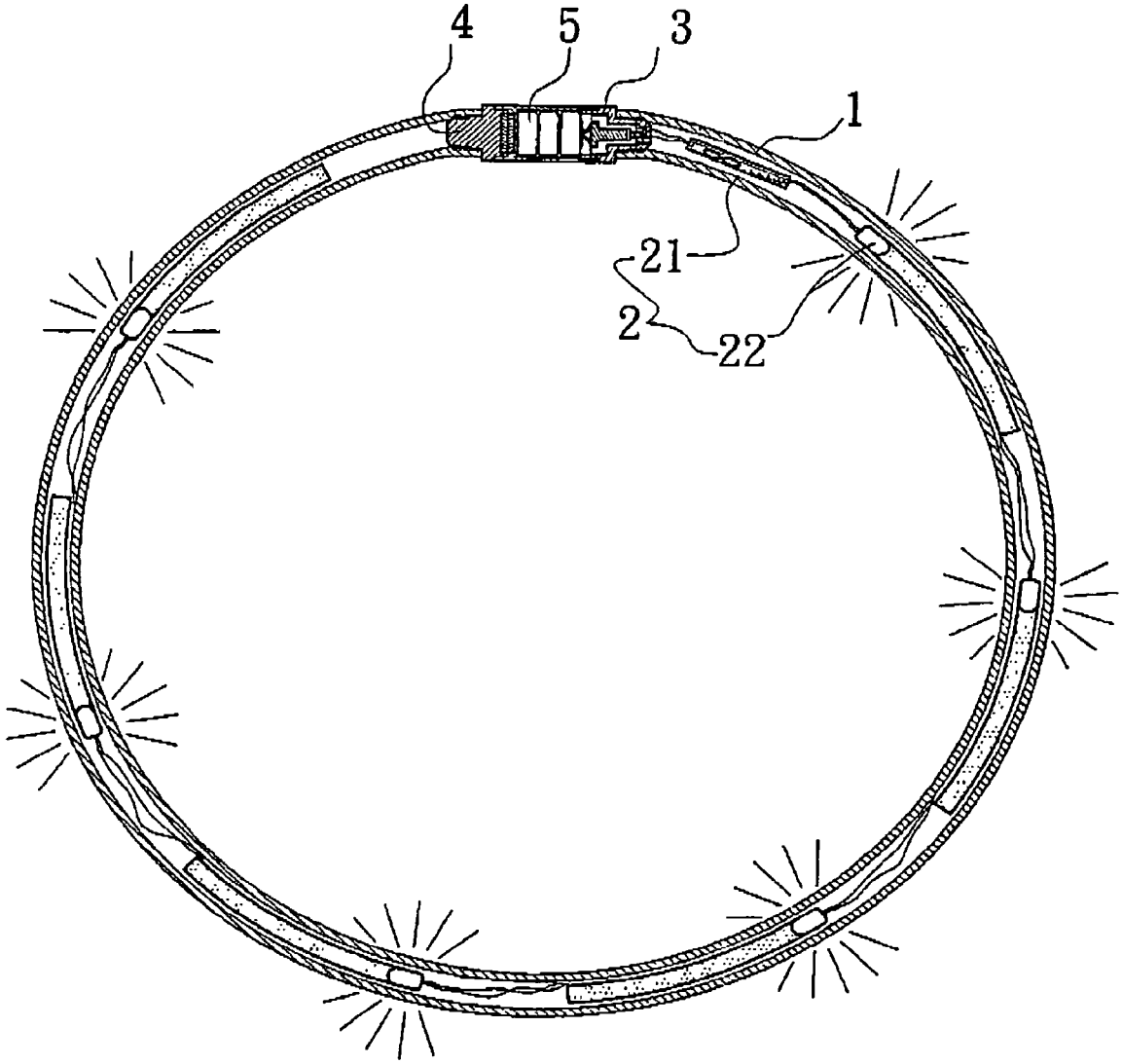
FIG. 2 is a sectional view of the shining personal adornment in the present invention, shining.
Figure 3:
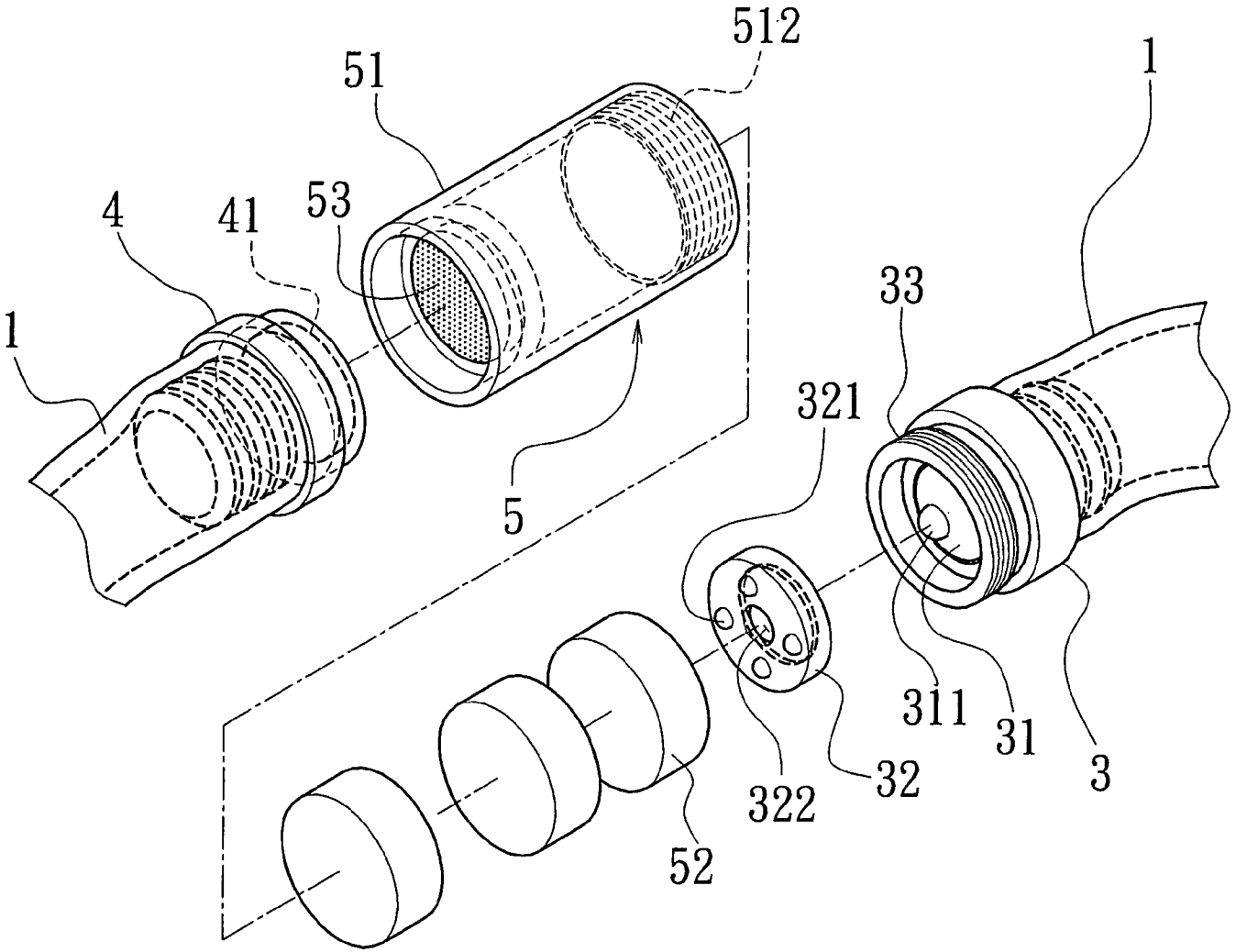
FIG. 3 is a partial exploded perspective view of the invention.
Figure 6:
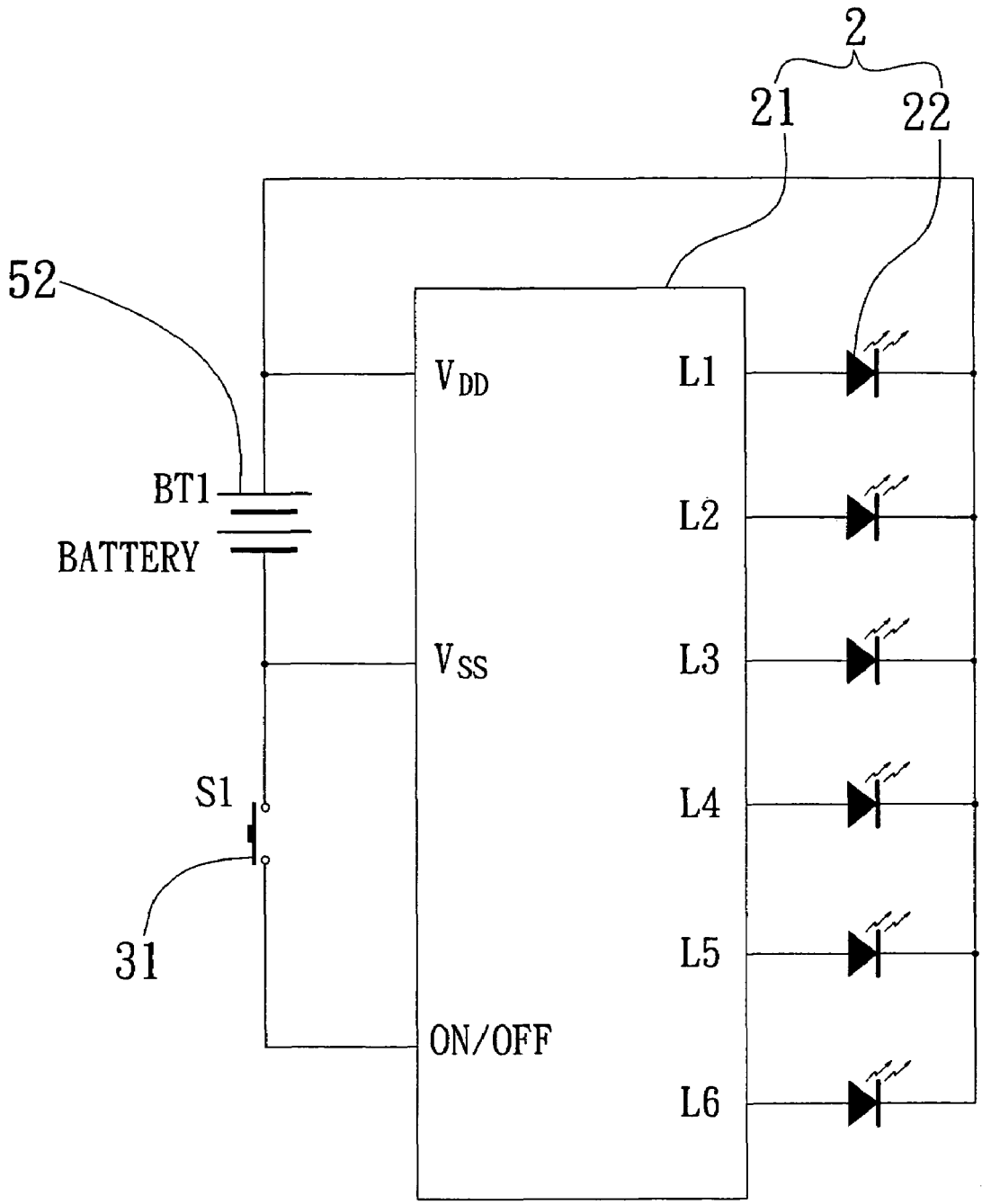
FIG. 6 is a circuit diagram of the present invention.

Referring to FIGS. 2, 3, and 6, a preferred embodiment of a shining adornment includes a hollow main body 1, a shining unit 2, a first connecting part 3, a second connecting part 4, and a power supplying unit 5.

The hollow main body 1 is transparent and soft. The shining unit 2 is held in the hollow main body 1, and it includes a control circuit element 21, and several light emitting elements 22 electrically connected to the control circuit element 21. The light emitting elements 22 can be light emitting diodes combined with optical fibers extending therefrom.

The first connecting part 3 is joined to one end of the hollow main body 1, and it has a threaded connecting portion 33 on an outer side thereof. A conducting element 31 is held in the first connecting part 3, and electrically connected to the shining unit 2 at an inner end. The conducting element 31 has a protruding portion 311 on an outer side thereof. And, a soft and elastic insulating ring 32, which has several bumps 321 on an outer side, and a middle through hole 322, is positioned on the outer side of the conducting element 31; the protruding portion 311 of the conducting element 31 is passed into the middle through hole 322 of the insulating ring 32.

The second connecting part 4 is joined to the other end of the hollow main body 1, and has a magnet 41 therein.

The power supplying unit 5 includes a housing member 51, several batteries 52 held in the housing member 51, and a magnet 53. The housing member 51 has an opening 511 at a first end thereof, a threaded connecting portion 512 on an inner side of the first end portion. The magnet 53 is secured in the housing member 51, near to a second end of the housing member 51.

Figure 4:
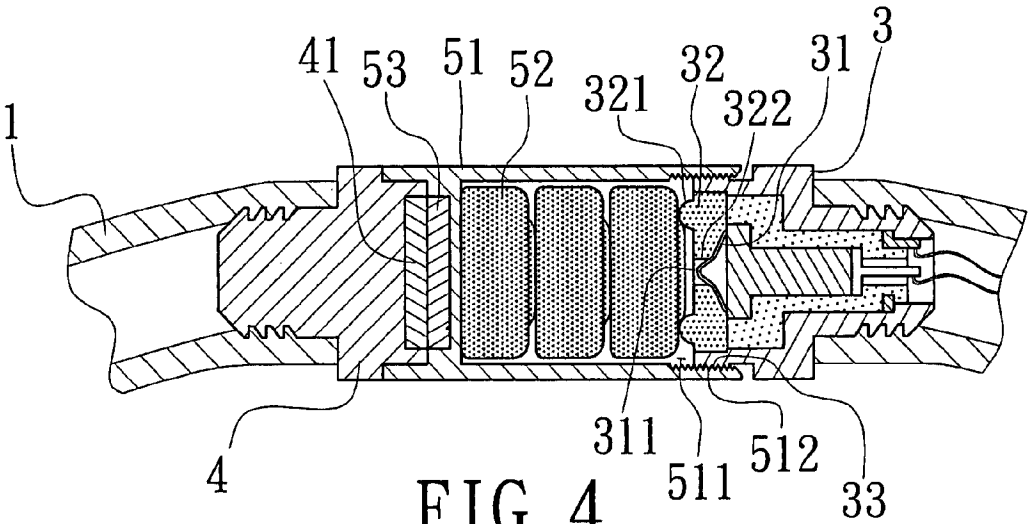
FIG. 4 is a partial section of the present personal adornment.

In assembly, referring to FIG. 4, the threaded connecting portion 33 of the first connecting part 3 is passed into and threadedly engaged with the threaded connecting portion 512 of the housing member 51. And, the second connecting part 4 is joined to the second end of the housing member 51 with the magnets 41 and 53 attracting each other. Thus, the whole personal adornment has a substantially circular shape, and the shining unit 2 can be turned on and turned off by means of changing the position of the first connecting part 3 in relation to the housing member 51 of the power supplying unit 5. The bumps 321 of the insulating ring 32 will touch an outermost one of the batteries 52, and the protruding portion 311 of the conducting element 31 will not if the threaded connecting portion 33 of the first connecting part 31 is only loosely connected to the threaded connecting portion 512 of the housing member 51. Therefore, the shining unit 2 will not be powered, and the light emitting elements 22 will not produce light.

Figure 5:
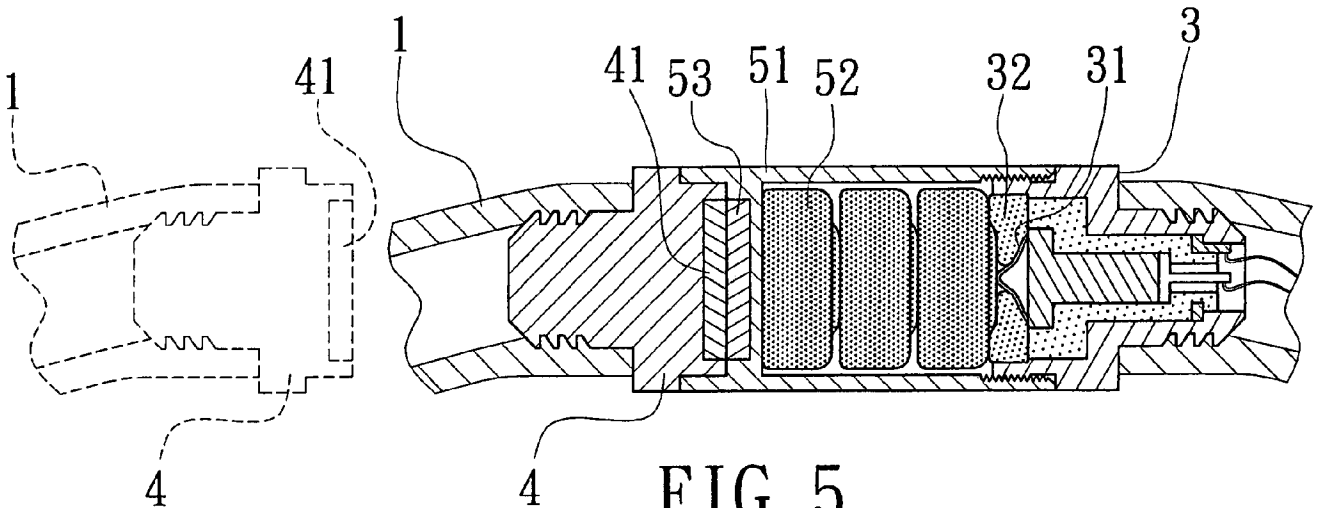
FIG. 5 is a partial sectional view of the shining personal adornment of the invention, shining.

Referring to FIG. 5, the conducting element 31 will compress the insulating ring 32, and the protruding portion 311 of the conducting element 31 will pass through the through hole 322 of the insulating ring 32 to touch the outermost one of the batteries 52 when the threaded connecting portion 33 of the first connecting part 31 is tightly connected to the threaded connecting portion 512 of the housing member 51. Thus, the shining unit 2 will be powered, and the light emitting elements 22 will produce light.

From the above description, it can be easily seen that the shining personal adornment of the invention has the following advantages: The second connecting part 4 can be easily separated from the housing member 51 of the power supplying unit 5 for the shining personal adornment to be used in other shapes instead of a circular one. The shining personal adornment can be positioned around a user's neck, wrists, arms, shoulders or a pet's neck instead of being just held in hands; in other words, the present invention is more fun to use, and can be used in more different ways as compared with conventional glowing sticks.

What is claimed is:

1. A shining personal adornment, comprising a hollow main body;

a shining unit held in the hollow main body;

a first connecting part joined to one end of the hollow main body; the first connecting part having a threaded connecting portion on an outer side thereof; the first connecting part holding a conducting element therein; the conducting element being electrically connected to the shining unit at an inner end thereof;

a second connecting part joined to other end of the hollow main body; and a power supplying unit including a plurality of batteries; the power supplying unit having a threaded connecting portion on an inner side of a first end portion;

the threaded connecting portion of the first connecting part being passed into and threadedly engaged with the threaded connecting portion of the power supplying unit; the second connecting part being joined to a second end of the power supplying unit; the conducting element being not going to be electrically connected to the batteries of the power supplying unit, and the shining unit being not going to be powered if the threaded connecting portion of the first connecting part is loosely connected to the threaded connecting portion of the power supplying unit; the conducting element being going to be electrically connected to the batteries of the power supplying unit, and the shining unit being going to be powered when the threaded connecting portion of the first connecting part is tightly connected to the threaded connecting portion of the power supplying unit.

2. The shining personal adornment as claimed in claim 1, wherein the second connecting part has a magnet secured thereto, and the power supplying unit has a magnet secured to the second end thereof such that the second connecting part and the power supplying unit will be joined together by means of force of attraction between both the magnets.

3. The shining personal adornment as claimed in claim 1, wherein the conducting element has a protruding portion on an outer side thereof, and an insulating ring, which has a middle through hole, is positioned on the outer side of the conducting element; the protruding portion of the conducting element being passed into the middle through hole of the insulating ring; the conducting element being going to compress the insulating ring with the protruding portion thereof being electrically connected to the power supplying unit when the threaded connecting portion of the first connecting part is tightly connected to the threaded connecting portion of the power supplying unit.

4. The shining personal adornment as claimed in claim 3, wherein the insulating ring has a plurality of bumps on a side thereof that faces the batteries of the power supplying unit.

5. The shining personal adornment as claimed in claim 1, wherein the shining unit includes a control circuit element, and a plurality of light emitting elements electrically connected to the control circuit element.

6. The shining personal adornment as claimed in claim 5, wherein the light emitting elements are light emitting diodes.

7. The shining personal adornment as claimed in claim 5, wherein the light emitting elements include optical fibers extending therefrom.

* * * * *